US006461179B1

(12) United States Patent
Sullivan et al.

(10) Patent No.: US 6,461,179 B1
(45) Date of Patent: Oct. 8, 2002

(54) VIBRATION RESISTANT ELECTRICAL CONNECTOR

(75) Inventors: John P. Sullivan, Arlington Heights, IL (US); Joseph F. Murphy, Waukegan, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 09/945,970

(22) Filed: Sep. 4, 2001

(51) Int. Cl.[7] ..... H01R 4/38; H01R 13/627

(52) U.S. Cl. ..... 439/254; 439/357; 439/439; 439/253

(58) Field of Search ..... 439/253, 257, 439/320, 322, 357

(56) References Cited

U.S. PATENT DOCUMENTS 3,964,772 A * 6/1976 Cox, Jr. ..... 228/154
4,090,759 A * 5/1978 Herrmann, Jr. ..... 439/279
4,801,277 A * 1/1989 Seilhan ..... 439/597
5,418,874 A * 5/1995 Carlisle et al. ..... 385/139
5,485,673 A * 1/1996 Lau ..... 264/267
5,830,009 A * 11/1998 Tettinger ..... 439/578
5,888,083 A * 3/1999 Seilhan et al. ..... 439/161
5,906,513 A * 5/1999 Peterson et al. ..... 439/320

* cited by examiner

*Primary Examiner*—Brian Sircus
*Assistant Examiner*—Chandrika Prasad
(74) *Attorney, Agent, or Firm*—Emrich & Dithmar

(57) ABSTRACT

A quick disconnect electrical connector resistant to vibration-induced disconnect includes a male connector and a female connector each having opposing segments of flexible thread which inter-engage when the male and female are assembled. The thread segments of the female connector are on a flexible wall which deflects to permit mating engagement when the two connectors are pushed together. The male and female connectors are keyed together when assembled to prevent rotation; and the flexible thread segments engage to prevent unintentional disconnect.

22 Claims, 16 Drawing Sheets

VIBRATION RESISTANT ELECTRICAL CONNECTOR

FIELD OF THE INVENTION

The present invention relates to electrical connectors; and more particularly, it relates to electrical connectors of the type which are referred to generally as "quick disconnect" connectors and which are used in commercial and industrial applications, particularly in the field of industrial automation and manufacturing.

BACKGROUND OF THE INVENTION

Typically, quick disconnect connectors for commercial and industrial applications of the type with which the present invention is concerned, include a male connector and a mating female connector. The male connector has metal connecting elements in the form of pins; and they are received in corresponding sockets or receptacles embedded in the mating female connector. Typically, these connectors have two to five poles plus a ground connection.

An important aspect of quick disconnect connectors is that there be some mechanical coupling to secure the male and female connectors together and maintain electrical continuity. Typically, in connectors of this type, the female connector (or the male) is provided with a mating threaded coupling member (such as a coupling nut); and the mating connector is provided with a mating threaded coupling portion so that after the electrical connection is established, the coupling members provide a mechanical connection securing the electrical connection. In some applications where the handling of the connectors may be often and perhaps somewhat rough, as well as in applications where the connectors are mounted to a machine and undergo periodic or continuous vibration, there is a tendency for the coupling nut to back off from its threaded engagement with the male connector, thus creating the possibility of an inadvertent or unintentional disconnect.

In addition to the problems mentioned above concerning the possibility that the male and female connectors may become disconnected as a result of vibration or handling, there is also a disadvantage with existing quick disconnect connectors in that it takes an appreciable time to secure a connection, primarily in manually threading the coupling nut of one connector onto the other connector. The amount of time for assembling a single connector combination may not be significant in an absolute sense, but when it is considered that in a large manufacturing environment there are literally thousands of such connectors around and that machines and control systems employing the connectors are continuously being re-positioned, tested and reassembled, over the period of months or a year, the amount of time required to assemble and disassemble threaded coupling nuts has proved to be appreciable.

SUMMARY OF THE INVENTION

The present invention contemplates that one of the electrical connectors (the female in the embodiment shown) have a cylindrical wall surrounding and spaced from an insulating insert in which connecting elements in the form of sockets are embedded. The cylindrical wall of the female connector is made of molded plastic, such as polyvinyl chloride and has a flexibility such that it may be deformed upon insertion of a mating male connector in order to receive the mating thread segments of the male connector without a turning motion. The interior surface of the cylindrical wall of the female connector is provided with first and second diametrically located, discrete segments of internal threads arranged in opposing relation. That is, one segment of internal threads may extend for approximately 90 degrees about the interior of the cylindrical wall; and a second segment of internal threads is arranged in opposing or facing relation and located on the interior surface of the opposite side of the peripheral wall. Between the two segments of thread, the wall is free of thread and may be smooth and cylindrical.

When used in connection with the present invention, the term "thread" includes not only conventional screw threads, extending helically about a central axis, but also a series of alternating ridges or crests and troughs arranged perpendicular to the longitudinal axis of the connector (sometimes referred to as "parallel" threads). Conventional screw threads may be preferred because they are compatible with the screw threads found on the many existing metal or rigid coupling nuts and male connectors found in manufacturing plants. However, parallel threads, when provided in discrete segments as disclosed, will engage and can be assembled by pushing two mating connectors together because the threads are flexible and they are provided in discrete segments so they will ride over one another upon assembly. Parallel threads will provide sufficient interlocking to require separating or pull forces in the range of interest to resist unintentional disconnects. Moreover, a "thread" includes at least two adjacent crest/trough combinations, whether parallel or helical.

The male connector preferably has corresponding, matching opposing segments of external thread on an outer cylindrical surface. The male and female connector inserts are keyed together so that when the keyway of the female is aligned with the key of the male connector, the matching thread segments are also aligned.

The male connector may then be inserted into the female connector by pushing the male connector directly into the female connector after the respective key and keyway have been aligned. In assembling the male connector to the female connector, the wall of the female connector deflects as the external thread segments of the male connector are assembled to the mating thread segments female connector. In other words, the outer wall of the female connector deforms into an elliptical form so that the interior threads of the female connector ride over the corresponding thread segments of the male connector.

Once the two connectors are assembled, the threads inter-engage (whether parallel or helical types). The connector is highly resistant to vibration because the male connector cannot be rotated relative to the female connector since they are keyed together. Moreover, it has been found that a substantial but adjustable pull force (in the range of ten to thirty pounds, for example) may be designed into the assembled connectors, depending upon the hardness of the material used in molding the cylindrical wall of the female connector on which the thread segments are formed and other factors.

It will be appreciated that the assembly time for establishing an electrical/mechanical connection with the improved connectors is substantially reduced. Moreover, the female connector of the present invention (with screw threads) is adaptable to mate with existing male connectors having external metal threads, and the male version of the instant connector with screw threads is equally adaptable to assembly with existing inner metal threads of rigid coupling nuts. The male connector of the present invention may be pushed directly into the existing coupling nuts of female connectors, or, if desired, the coupling nuts can be threaded onto the thread segments of the male connectors constructed according to the present invention.

Other features and advantages of the present invention will be apparently to persons skilled in the art from the following detailed description of a preferred embodiment accompanied by the attached drawing wherein identical reference numerals will refer to like parts in the various views.

DETAILED DESCRIPTION OF THE PREFERRED EMBODIMENT

Figure 1:
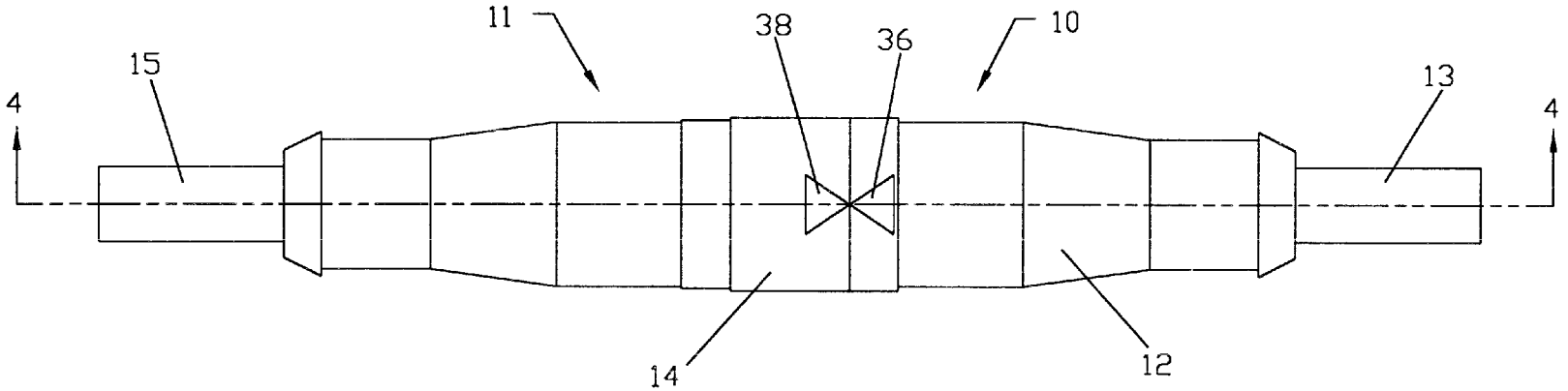
FIG. 1 is a side view of a male connector and female connector constructed according to the present invention in assembled relation.
Figure 2:
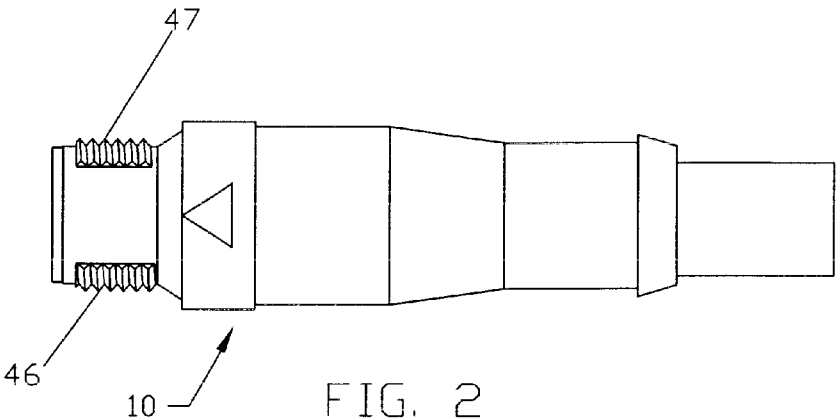
FIG. 2 is a bottom view of the male connector of FIG. 1.
Figure 3:
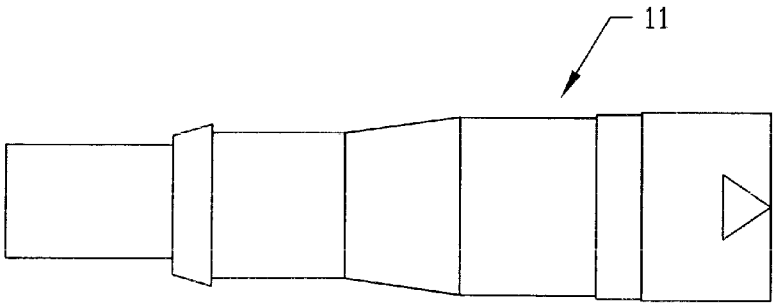
FIG. 3 is a bottom view of the female connector FIG. 1.

Referring to FIGS. 1–3, reference numeral 10 generally designates a male electrical connector, and reference numeral 11 generally designates a female electrical connector. The connectors 10, 11 are shown in assembled relation in FIG. 1, the male connector is shown in bottom view in FIG. 2, and the female connector is similarly shown in FIG. 3. As used herein, the terms "forward" or "distal" with reference to a connector, whether male or female, refers to the connecting end—that is, the end which couples to the mating connector. The terms "proximal" or "rear" refer to the portion of a connector closer to its associated cable.

Turning first to the female connector 11, it is shown in greater detail in FIGS. 8 through 13. However, as seen in FIGS. 1 and 3, the exterior of the female connector includes an overmold body designated 12 which encompasses the connecting elements, to be described. The connecting elements may be conventional, and they are conventionally connected to the individual wires of a jacketed cable 13. The overmold body 12, as is known, provides a protective coating over the juncture between the cable 13 and the individual connector elements of the connector 11, as will be described. Moreover, the overmold 12 provides a protective sheath and strain relief for the connector. Similarly, the male connector includes an overmold body 14 and it may be connected to the individual wires of a cable 15. The overmold bodies 12, 14 are made of molded plastic such as polyvinyl chloride.

Figure 9:
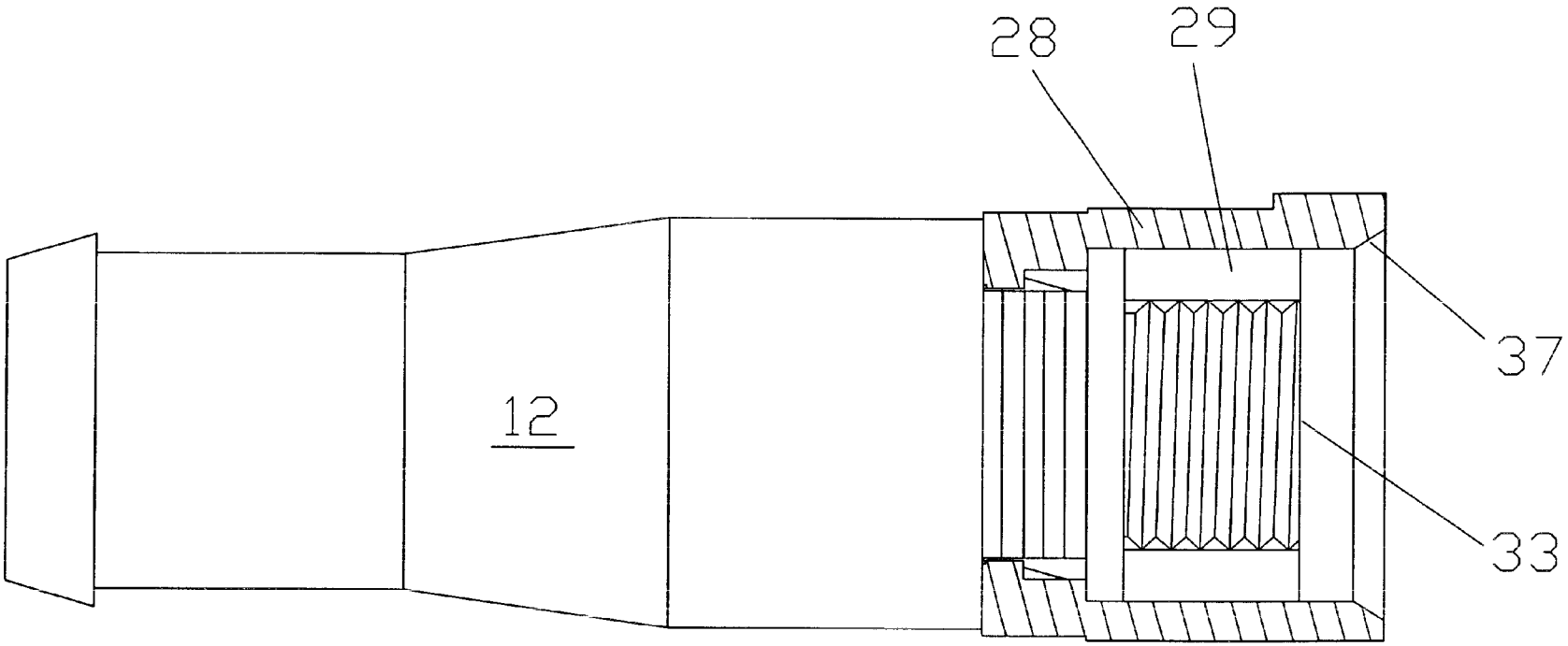
FIG. 9 is a side view of the female connector of FIG. 1 with a partial section of the connecting end thereof, taken along the section line 9—9 of FIG. 8.
Figure 10:
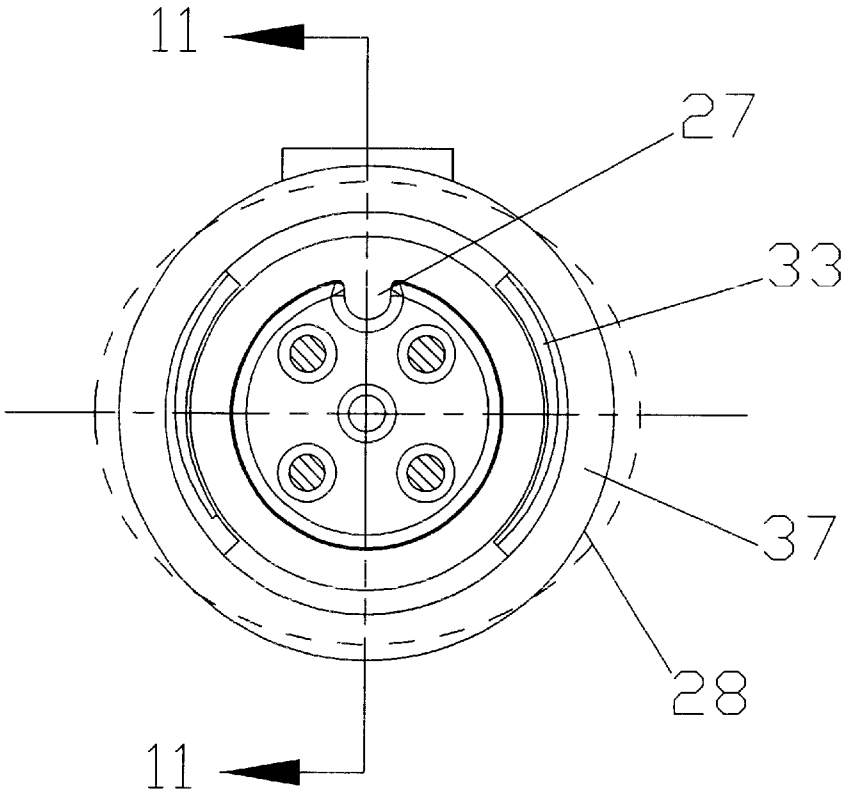
FIG. 10 is a view similar to FIG. 8 of the female connector showing deflection of the flexible wall connection.
Figure 11:
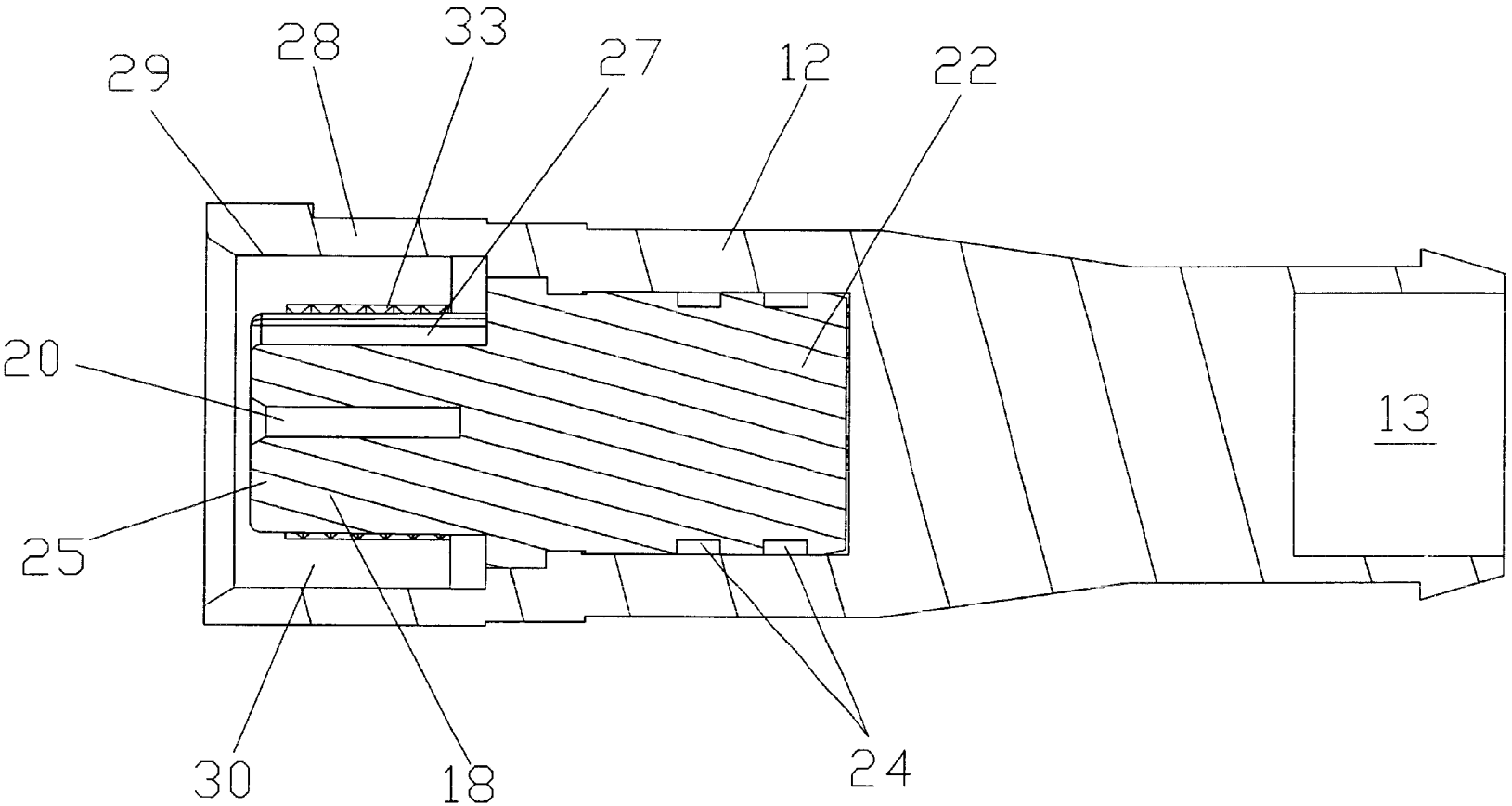
FIG. 11 is a cross section view of the female connector taken along the section line 11—11 of FIG. 10.
Figure 12:
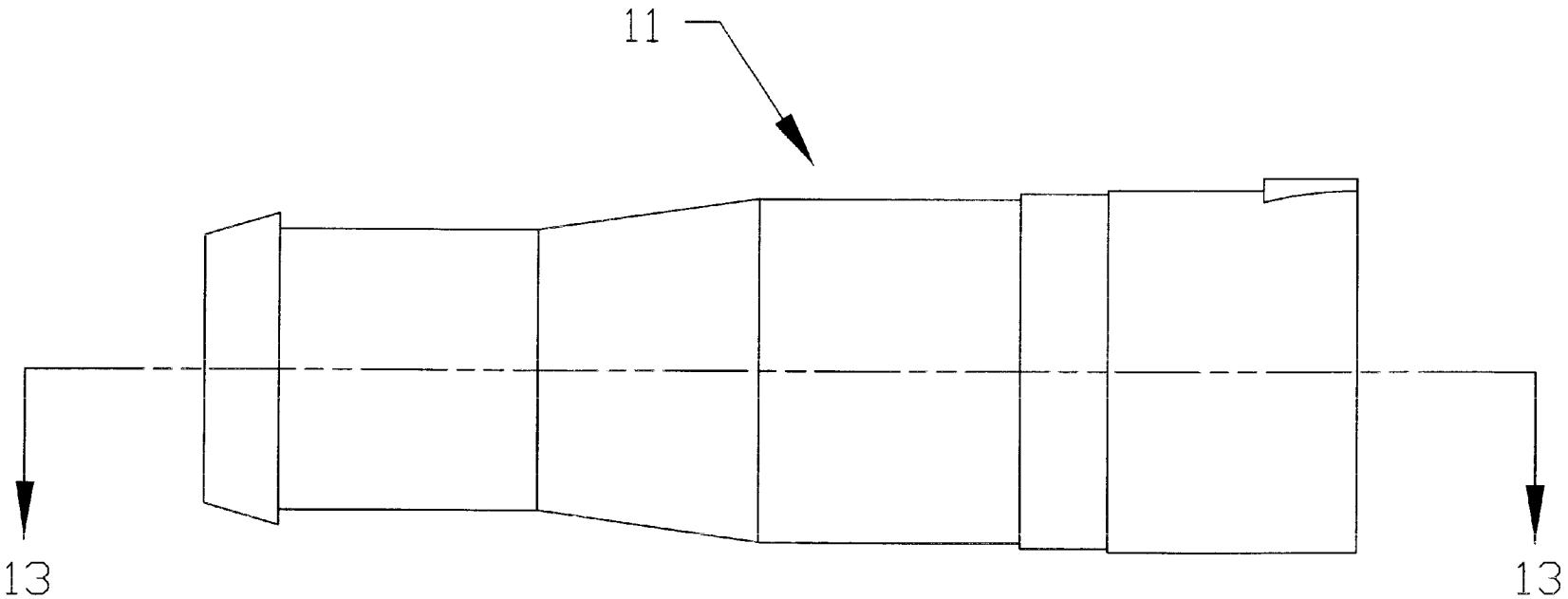
FIG. 12 is a side view of the female connector of FIG. 1.

Turning then to the female connector 11 as seen in FIGS. 8–13, it includes an insert body 18 of rigid plastic material and having insulating properties to receive and support individual female connecting elements 19 which are conventional sleeves or receptacles, and a separate, central sleeve 20 for a ground connection. Referring particularly to FIG. 11, the female insert 18 includes a base 22 on which the overmold 12 is formed. To provide greater mechanical bonding with the overmold 12, the base 22 of the insert may be provided with peripheral grooves such as those designated 24 in FIG. 11. Extending forwardly (to the right in FIG. 11) the insert 18 includes a generally cylindrical projecting portion 25 integral with the base 22, and forming a rigid body for holding and supporting the electrical connecting elements 19, 20.

Figure 8:
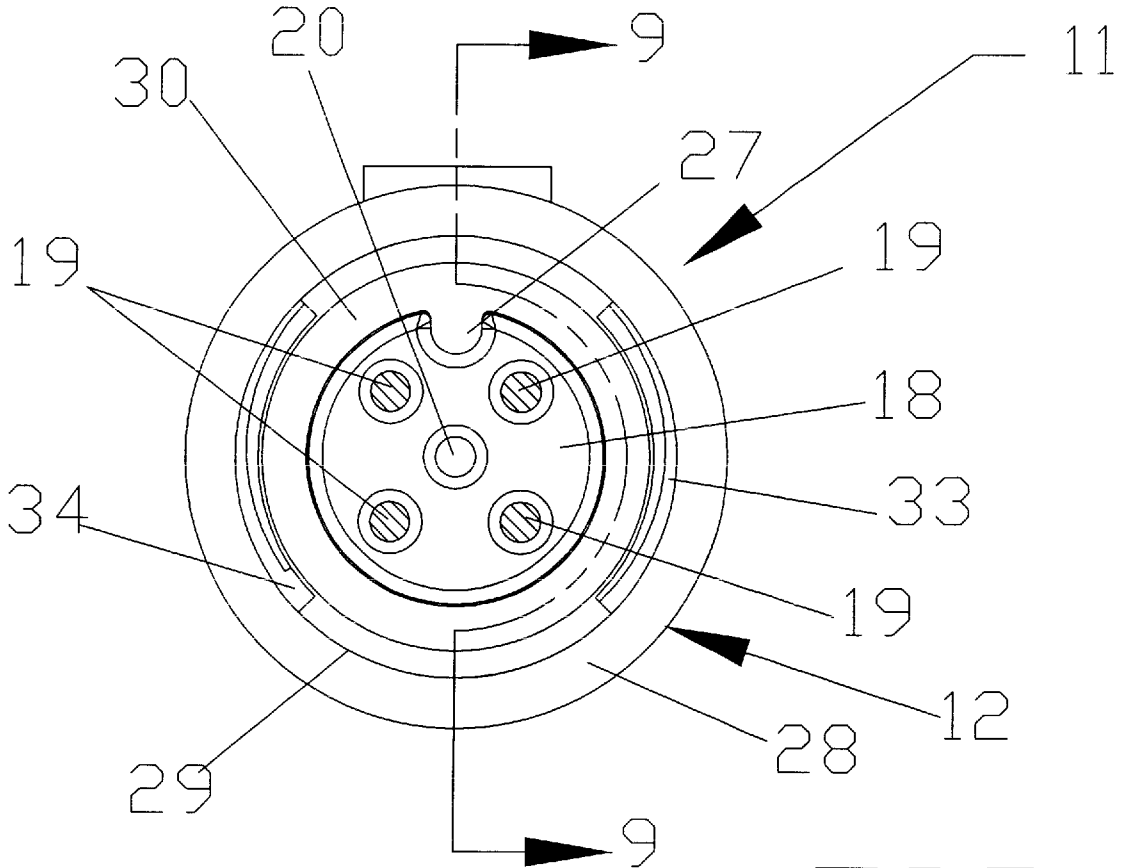
FIG. 8 is an end view of the female connector of FIG. 1 looking at the connecting end thereof.

As best seen in FIGS. 8 and 11, a keyway or slot 27 is formed in the cylindrical projecting portion 25 which has a diameter less than that of the base 22 in the embodiment shown. Moreover, at the forward portion of the overmold 12, there is formed a cylindrical wall 28 which surrounds the projecting portion 25 of the insert 18. An interior cylindrical surface 29 of the cylindrical wall 28 of the overmold is spaced from the cylindrical side of the projecting portion 25 of the insert 18 to form an annular space generally designated 30 which, as will be described, receives a surrounding wall of the male connector.

Turning now particularly to FIGS. 8–10, the interior cylindrical surface 29 has integrally molded onto it, first and second segments of inner threads. These two segments are designated respectively 33 and 34. The threads may be formed in the pattern of a continuous helical thread (screw thread). That is, the crests and troughs of the threads on a segment 33 form the same pitch as, and lead into the threads on the segment 34. The threads are interrupted however. Moreover, the threads may be a standard thread of screw type found in conventional connectors of this type having coupling nuts with interior threads, in which case, of course, the threads are rigid and continuous, such as a conventional 12 m×1 thread.

Figure 4:
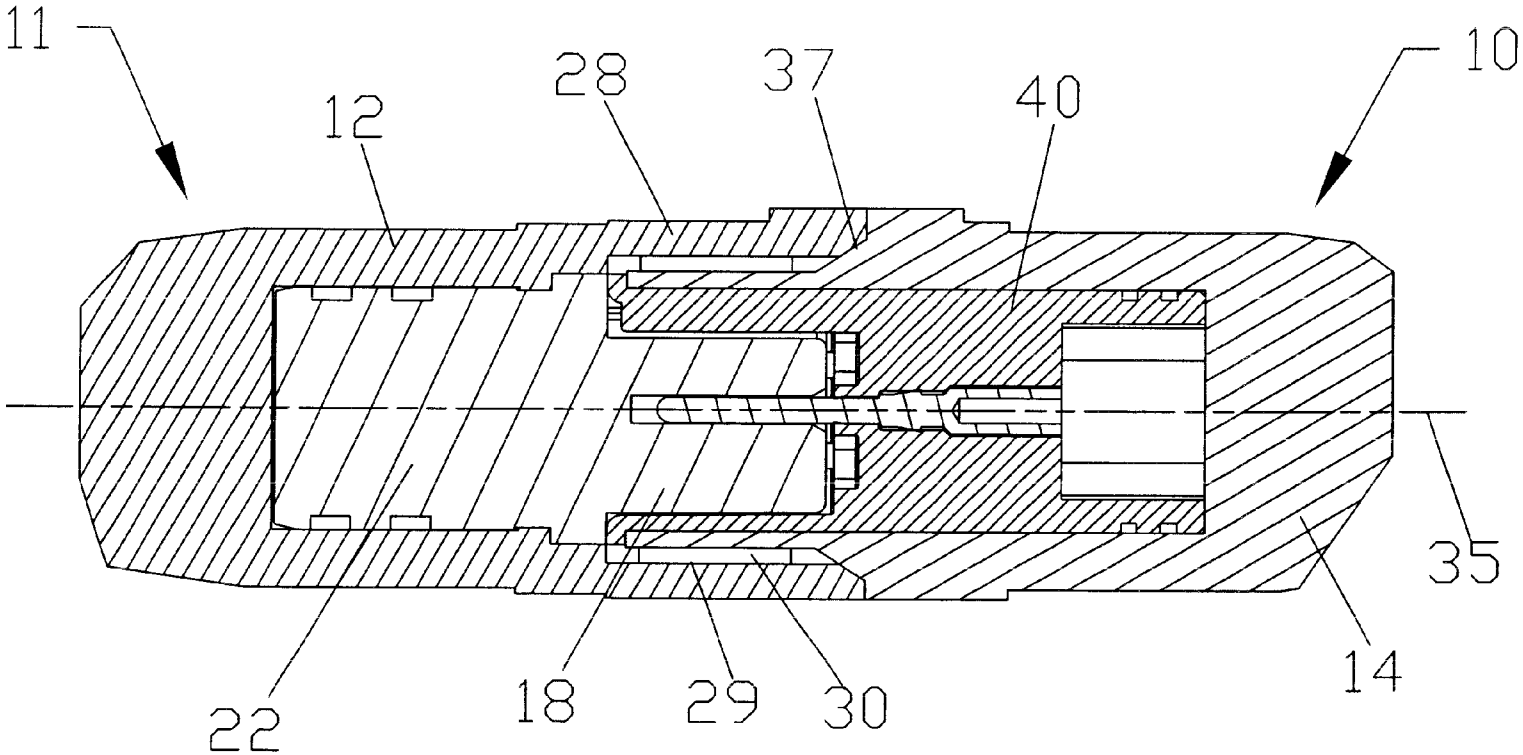
FIG. 4 is a cross sectional view of the assembled male and female connectors of FIG. 1 taken through the section line 4—4 as seen in FIG. 1.
Figure 5:
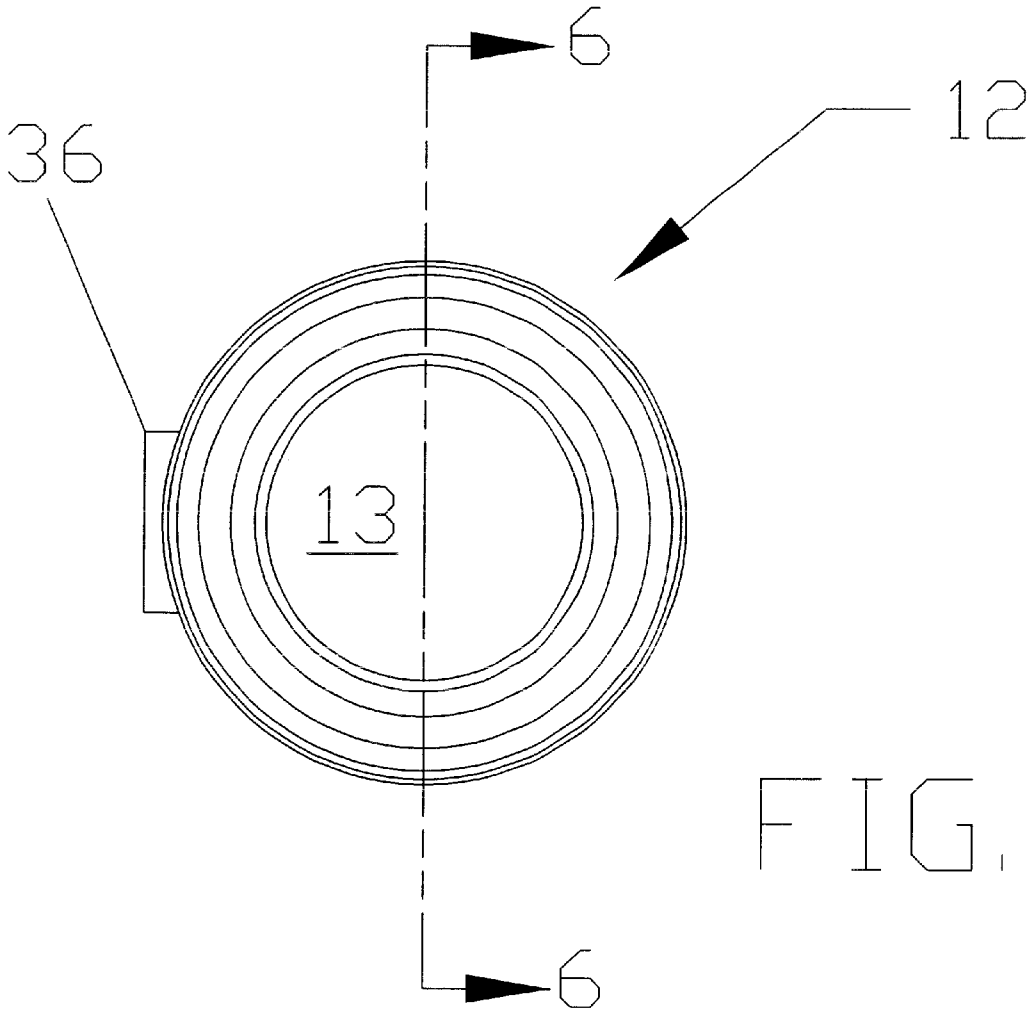
FIG. 5 is an end view of the male and female connectors seen in FIG. 1 taken from the right side thereof.

Alternately, the threads may be parallel—that is, arranged in planes perpendicular to the axis of the connector, designated 35 in FIG. 4. The thread segments 33, 34 are molded as an integral part of the overmold 12, and therefore made of the same material and flexible. The molding material may be a polyvinyl chloride, and have a durometer rating in the range of approximately 70–100 on the Shore A scale. For the standard thread size indicated above, a durometer rating of 80 on the Shore A scale provides a 15 pound pull force required to disconnect the female connector from the male connector to be described. A durometer rating of 92 on the Shore A scale for the structure described results in a pull force of approximately 25 pounds to disconnect the male and female connectors.

Persons skilled in the art will appreciate that pull forces may be designed over a wide range by adjusting the number of threads, the included angle over which the thread segments extend and the hardness of the molding material of the overmold body.

Figure 13:
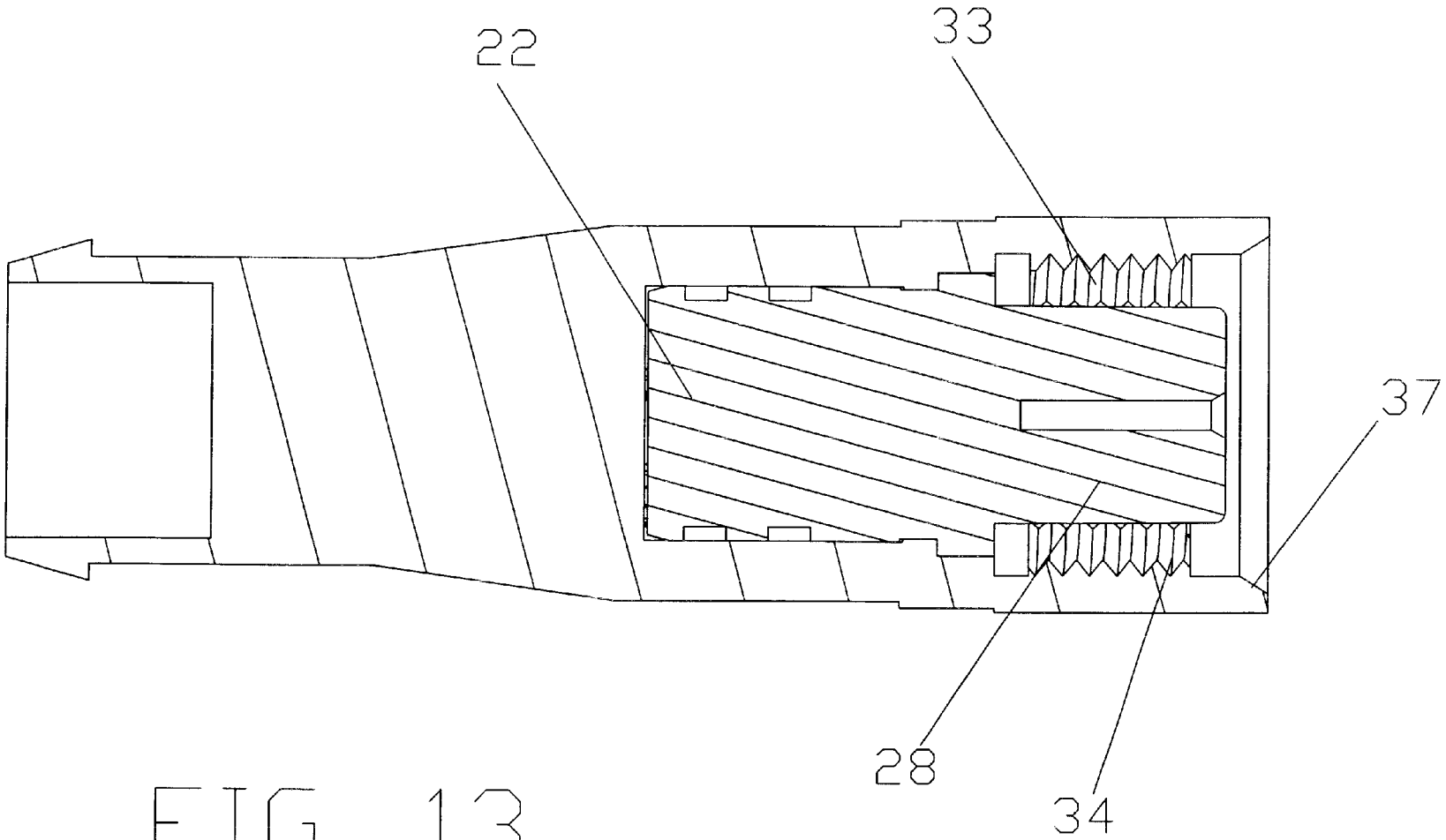
FIG. 13 is a cross section view taken along the section line 13—13 of FIG. 12.

Turning particularly to FIG. 9, the thread segment 33 formed on the interior surface 29 of the peripheral wall 28 is seen to be similar to a corresponding thread formed in a rigid coupling nut of the type presently commercially available, however, the segment is not continuous around the interior of the peripheral wall 28, and the threads are made of a flexible plastic material. The leading edge of the wall 28 may be chamfered as seen at 37 in FIG. 9 to provide a guide or centering surface when connecting male and female connectors, and to engage with a correspondingly chamfered surface 50 on the male connector. The interface may thus provide a seal against dust, debris and water, though the seal is not intended to be a pressure seal. FIG. 13 is a longitudinal cross section of the female connector similar to that seen in FIG. 11, but wherein the connector is rotated 90 degrees on its axis (compare the section lines of FIG. 10 and FIG. 12).

As seen best in FIG. 1, the overmold material 14 is formed to include an indicator 36 which, in the illustrated embodiment, is in the form of an arrowhead. The indicator 36 may be used in the lining of the male and female connectors during assembly, as will be apparent from further description. A corresponding indicator in the form of an arrow is located on the male connector 10 and designated 38.

Figure 14:
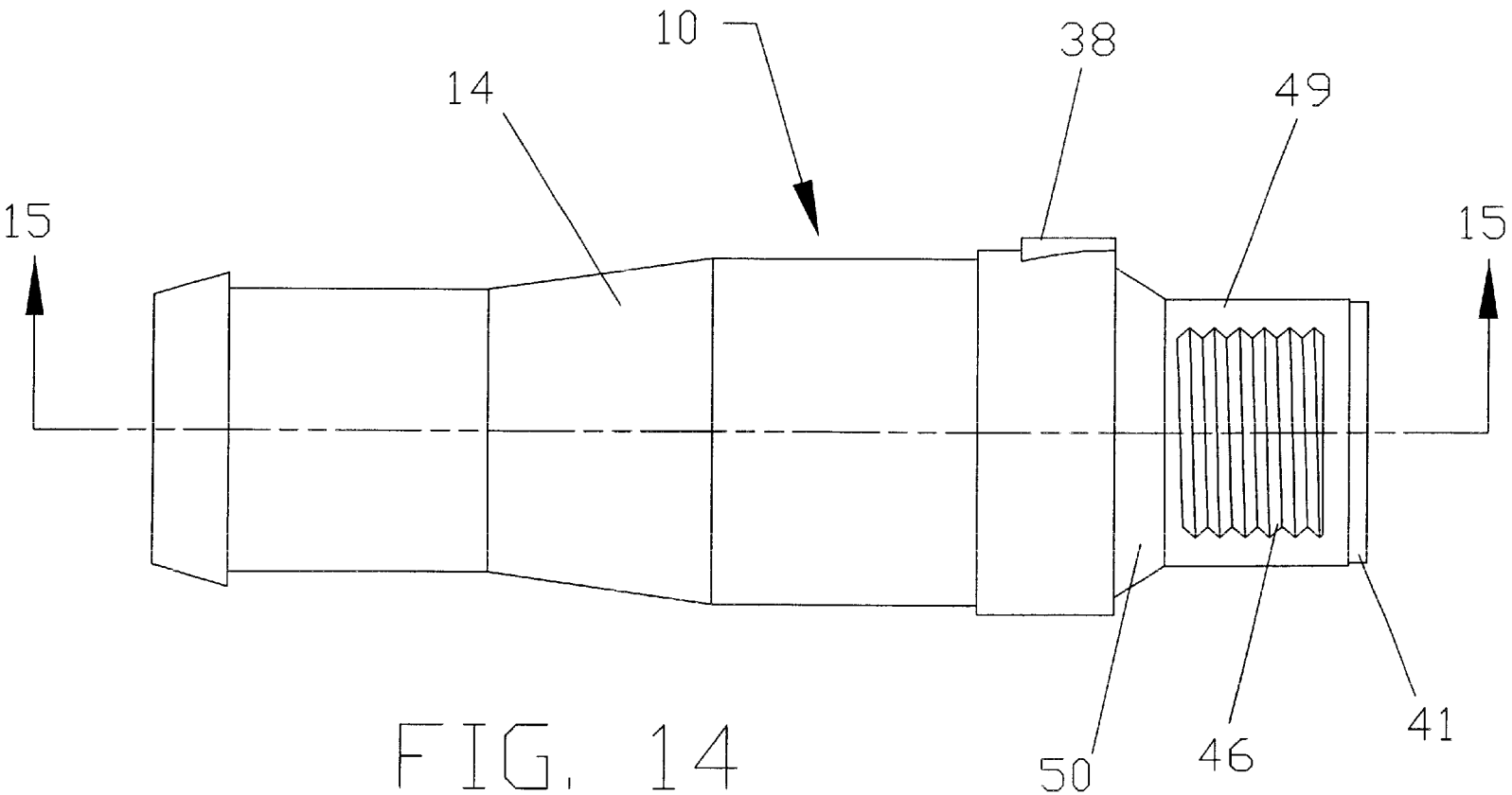
FIG. 14 is an enlarged side view of the male connector of FIG. 2.
Figure 15:
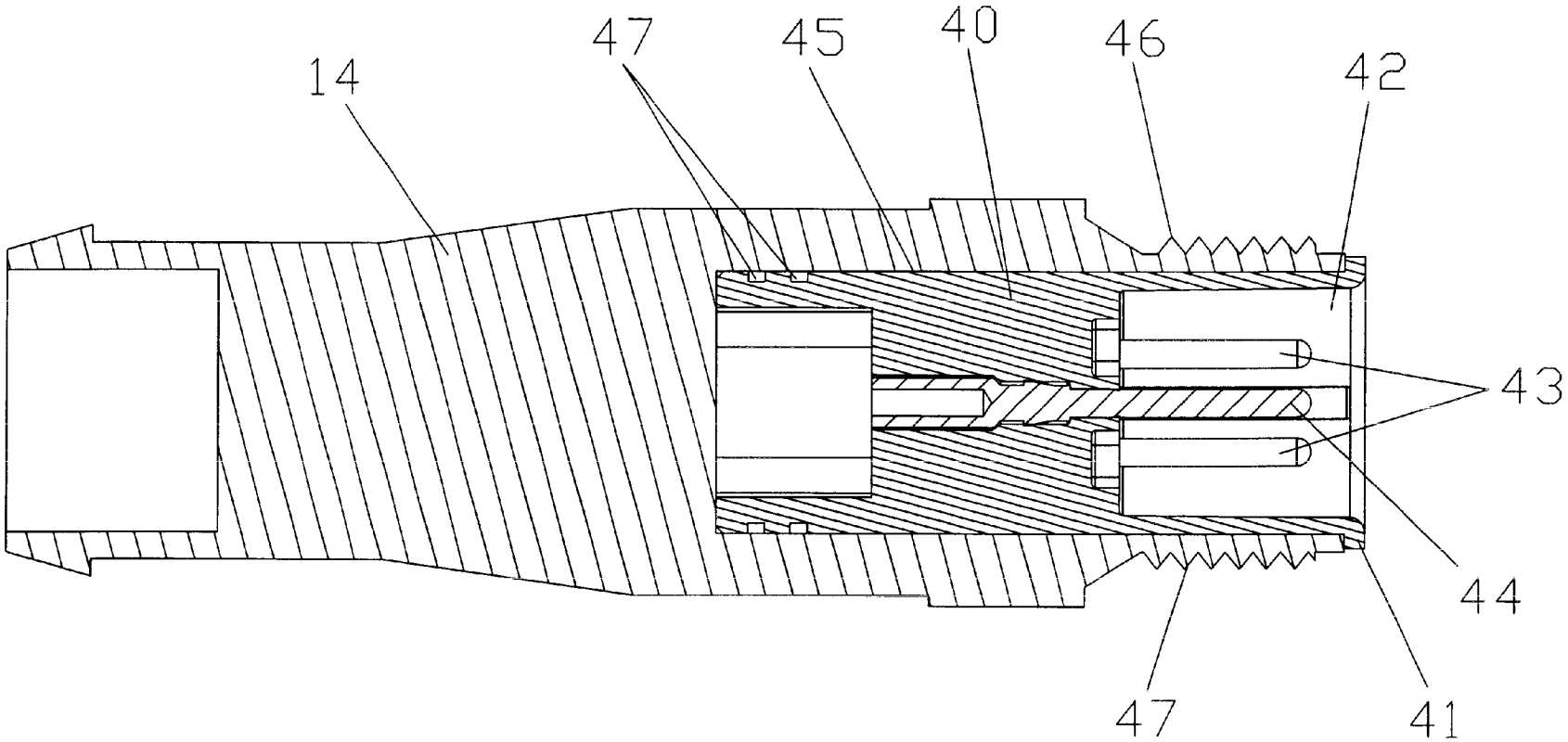
FIG. 15 is a cross section view taken along the section line 15—15 of FIG. 14.

Turning now to FIGS. 14–17 a male insert 40, preferably formed of a rigid, insulating, suitable plastic is generally cylindrical in form and elongated axially as seen in FIG. 15. Male insert 40 includes, at its forward portion, a cavity which is generally cylindrical and designated 42 for housing a plurality of male contact elements in the form of pins 43, and a central ground pin 44. The protective overmold 14 is formed about the exterior cylindrical surface 45 of the male insert 40, and the male insert 40 also may include grooves 47 to improve the mechanical bond with the overmold 14. The forward end of the male insert 40 is formed into an outwardly extending peripheral flange 41. At the forward end of the overmold 14, there are provided first and second segments of male threads designated respectively 46 and 47 in FIG. 15.

The thread segment 46 is seen in FIG. 14, and it is formed on the outer cylindrical surface 49 of the forwardmost portion of the overmold 14. Forward of the indicator 38, and inboard of the cylindrical surface 49, there is a chamfered or frusto-conical surface 50 for engaging and sealing with the corresponding mating surface 37 of the female connector as described.

The male thread segments 46, 47 may also be formed as segments of a continuous male screw thread having the same pitch, thread size and diameter as the corresponding inner threads on the female connector, and as the corresponding threads on the rigid metal connectors of conventional female connectors, or they may be parallel ridges/grooves. The included angle of the thread segments of the male connector may also be 90 degrees, as with the corresponding female thread segments. However, the thread segments may extend in the range of 60°–120° approximately with changes in the pull force required for disconnection.

Figure 16:
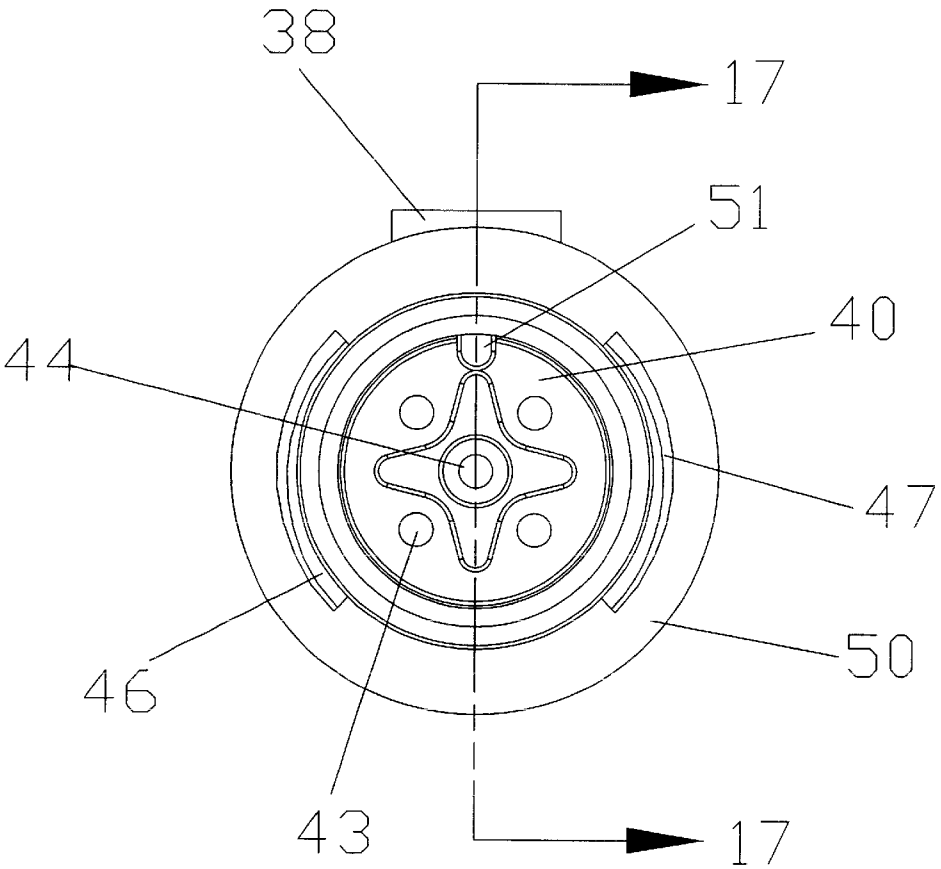
FIG. 16 is an enlarged end view of the connecting end of the male connector of FIG. 2.
Figure 17:
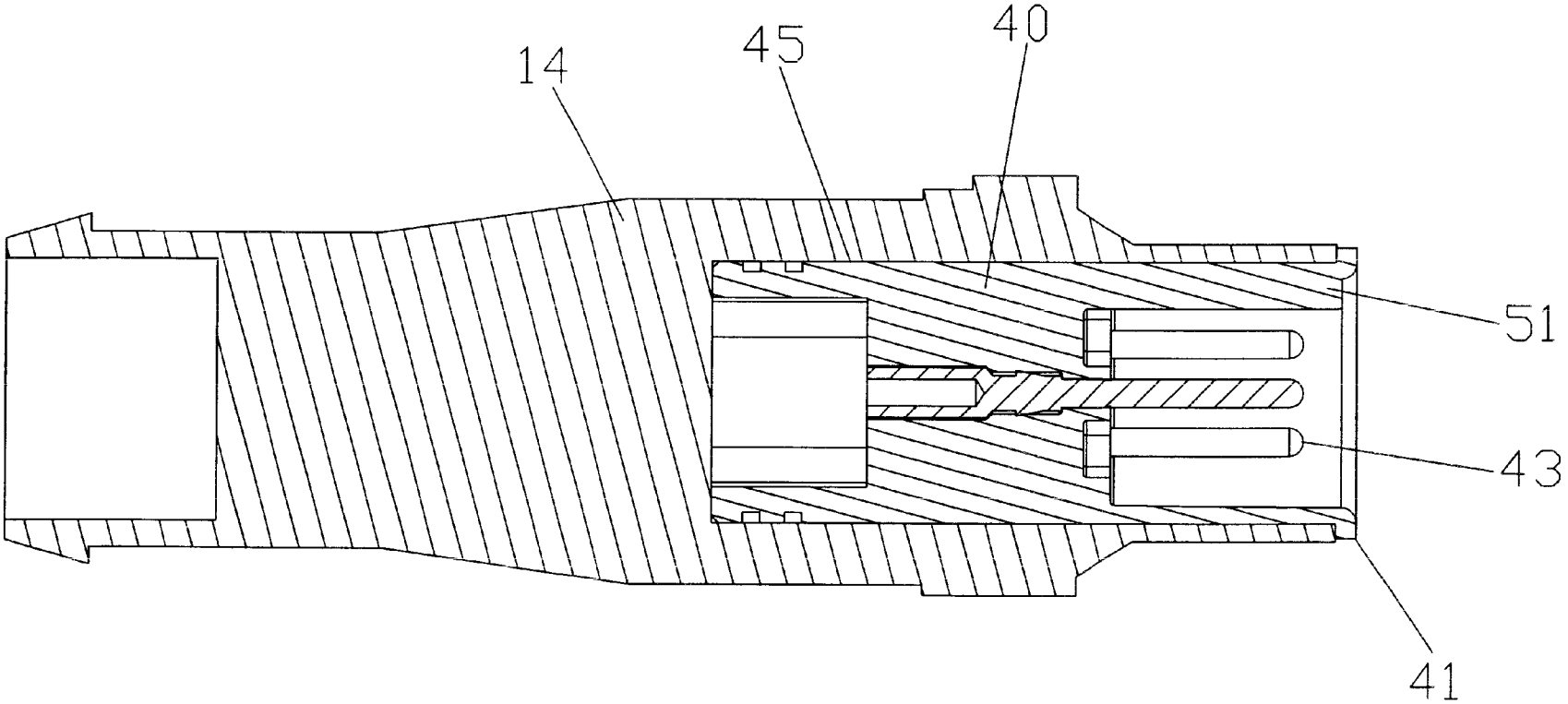
FIG. 17 is a cross section view taken along the section line 17—17 of FIG. 16.

The male insert 40 also includes a key 51 which extends axially of the connector and is sized to be received in the keyway 27 of the female insert (see FIGS. 8 and 16).

Refer now to FIG. 4, when the male connector 10 is assembled to the female connector 11, as seen in FIG. 4, the key 51 of the male insert 40 is received in the corresponding keyway 27 of the female insert 18. This not only orients and locates the corresponding connecting elements correctly, but it prevents turning of the connectors once they are connected together. The male connecting elements or pins are received in the corresponding female connecting elements or sockets; and the frusto-conical surfaces 37, 50 are in contacting relation.

Figure 6:
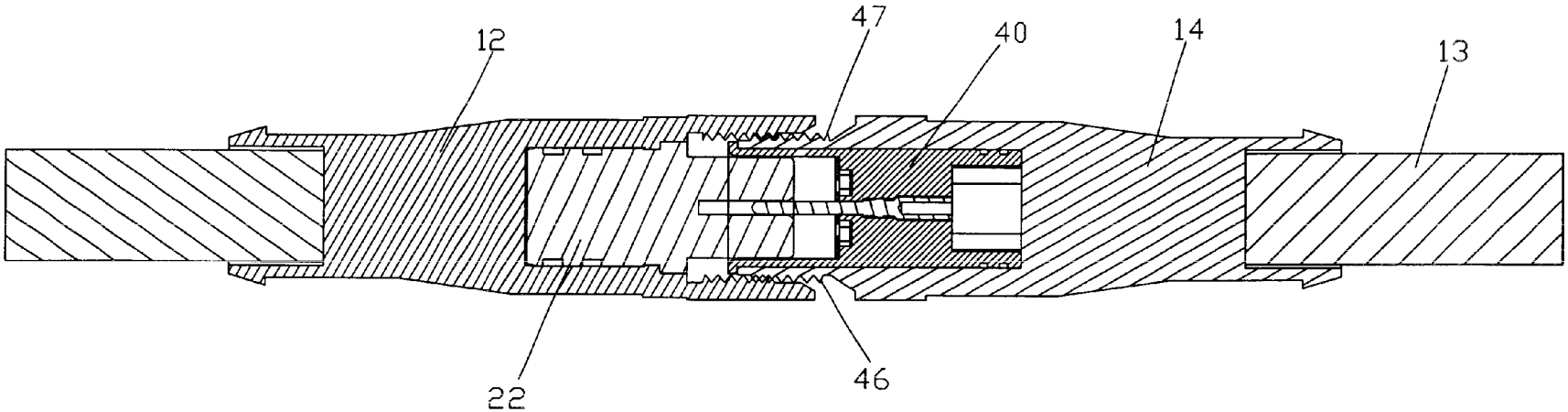
FIG. 6 is a cross sectional view of the male and female connectors of FIG. 1 taken along the section line 6—6 of FIG. 5 with the threads partially engaged.
Figure 7:
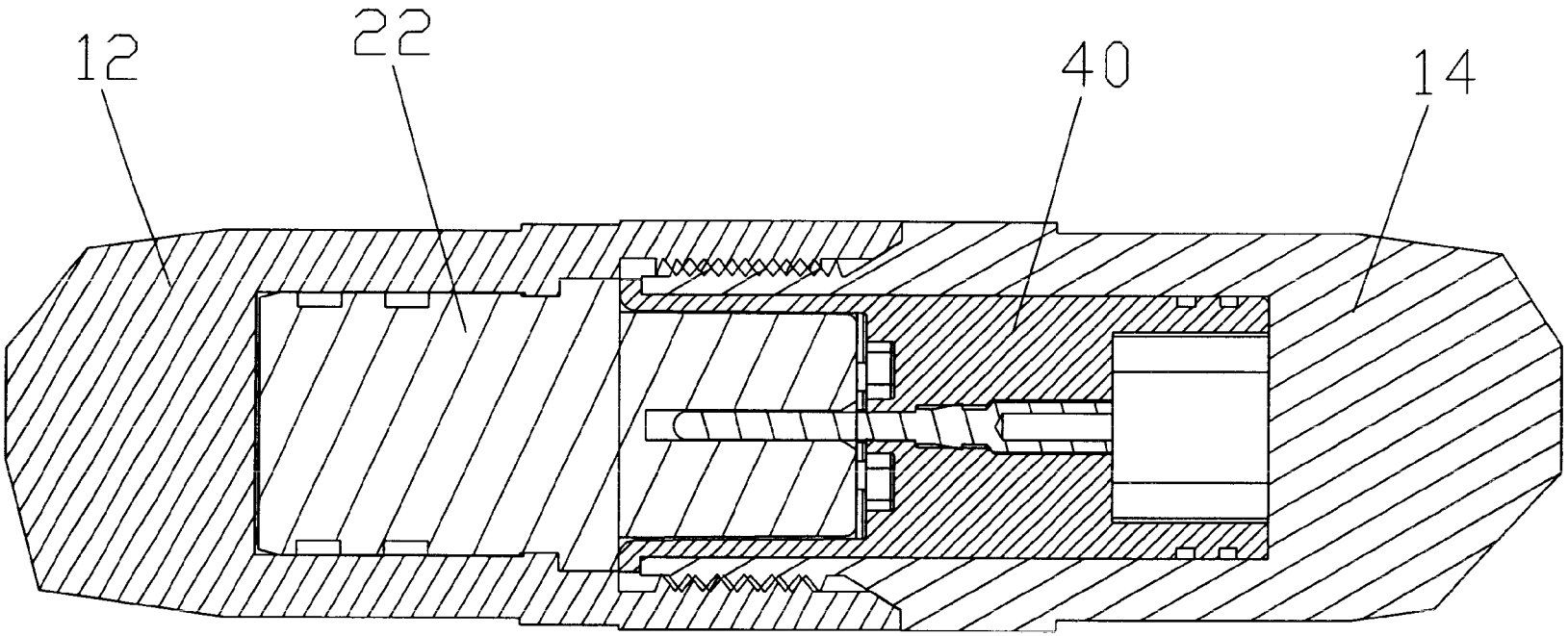
FIG. 7 is a close-up view similar to FIG. 6 without the cables and with the threads fully engaged.

FIG. 6 shows male and female connectors in partial engaging relation. Because both the male thread segments and the mating female thread segments are provided in segments rather than continuous thread, and because the cylindrical wall 28 on which the female thread segments are formed is flexible, when the two connectors are aligned and pushed together, the flexible cylindrical wall 28 of the female connector becomes somewhat elliptical. That is, it bulges out laterally as seen by the dashed line in FIG. 10, because the corresponding male threads push on the female thread segments, and forcing them outwardly; and the opposing unthreaded portions of the wall 28 come closer together, as also illustrated by dashed line in FIG. 8. The process of assembling a male connector to a female connector gives the user a tactile, feeling indicating correct assembly as the crests of one thread segment ride over the crests and into the troughs of the mating thread segment on the mating female connector.

Once the thread segments are assembled, it is assured that corresponding mating thread segments are fully engaged because of the locating function performed by the key and keyway and the chamfered engaging surfaces mentioned above. The removal force, that is, the force necessary to disconnect the male and female connectors, if both connectors are made as indicated herein, depends upon the factors described above. However, in any case, the connector of the present invention is much more resistant to unintentional disconnection through vibration or handling than are the previous connectors made of rigid, full threads and employing a coupling nut.

Moreover, the pull force need to disconnect the instant connectors may be varied according to the application or the intention of the manufacturer. Further, the male connector 10 (with flexible screw thread segments) may be used in combination with existing female connectors having rigid coupling nuts, and the female connector 11 may equally well be used with existing commercial connectors having rigid outer threads such as those almost universally used on sensor bodies widely found in current industrial automation applications.

Having thus disclosed in detail various embodiments of the invention, persons skilled in the art will be able to modify certain of the structure which has been disclosed and to substitute equivalent materials or elements for those described while continuing to practice the principle of the invention; and it is, therefore, all such modifications and substitutions be covered as they are embraced within the spirit and scope of the independent claims.

We claim:

1. An electrical connector comprising:

an insert of non-conducting material;

a plurality of electrical connecting elements carried by said insert;

a protective overmold body extending at least partially about said insert and defining a generally cylindrical surface extending circumferentially about said connecting elements, said overmold body further defining first and second segments of flexible threads formed on said cylindrical surface and diametrically located relative to each other.

2. The connector of claim 1 wherein said connecting elements are female and said connector is a female connector, said protective overmold body including a cylindrical flexible wall defining said cylindrical surface on the interior of said wall and spaced from an opposing wall of said insert to define an annular region for receiving a male insert of a mating male connector.

3. The apparatus of claim 2 wherein said female insert includes one of a key and keyway for assembling to the other of a key and keyway on a male insert, whereby said female connector may not be turned relative to a mating male connector to which it is assembled.

4. The apparatus of claim 3 wherein said thread segments define discontinuous portions of a helical thread.

5. The apparatus of claim 3 wherein said thread segments comprise discontinuous parallel threads.

6. The apparatus of claim 1 wherein said connecting elements are male and said connector is a male connector; and said protective overmold includes a cylindrical outer wall providing said cylindrical surface on the exterior of said outer wall of said male insert and adapted to be received in an annular space of a mating female connector.

7. The apparatus of claim 6 further including a female connector comprising a female insert carrying female connecting elements; and an overmold body including a flexible cylindrical wall defining opposing segments of threads on opposing sides thereof, said female insert defining an outer flexible wall spaced from said cylindrical outer wall of said male connector when said male and female connectors are assembled together and corresponding thread segments of said male and female connectors are interengaged.

8. The apparatus of claim 7 wherein one of said male and female inserts defines a keyway and the other of said male and female inserts defines a key adapted to be received in said keyway when said male and female connectors are connected together.

9. The apparatus of claim 8 characterized in that a pull force in the range of 10–30 pounds is required to disconnect said male and female connectors when assembled together.

10. The apparatus of claim 9 wherein each of said segments of thread extend about its associated cylindrical overmold surface over an included angle in the range of 60°–120°.

11. The apparatus of claim 9 wherein each of said segments of thread extend over an included angle of approximately 90°.

12. The apparatus of claim 11 wherein said peripheral wall of said female connector defines a first frusto-conical surface and said overmold body of said male connector defines a second frusto-conical surface adapted to engage and seal with said first frusto-conical surface when said male and female connectors are assembled.

13. Apparatus comprising:

an insert of insulating material;

a plurality of female connecting-elements at least partially embedded in said insert;

an electric cable including a plurality of wires, each connected to an associated one of said female connecting elements;

an overmold body molded about a portion of said insert and an adjacent portion of said cable, said overmold body including a generally cylindrical, flexible wall having an inner surface opposing and spaced from said insert and at least first and second separated segments of thread integrally molded onto said inner surface.

14. The apparatus of claim 13 wherein said thread segments include helical screw threads.

15. The apparatus of claim 13 wherein said thread segments include parallel threads.

16. The apparatus of claim 13 wherein said overmold body is made of a moldable plastic material having a hardness measuring in the range of approximately 70 to 100 in the Shore A scale.

17. The apparatus of claim 16 wherein each of said thread segments extends circumferentially about said inner surface over an included angle in the range of approximately 60°–120°.

18. The apparatus of claim 17 wherein said included angle for each thread segment is approximately 90°.

19. An electrical connector comprising:

an insert of insulating material;

a plurality of connecting elements at least partially embedded in said insert;

an electrical cable having a plurality of wires; and an overmold body of moldable plastic material having a durometer rating in the range of approximately 70 to 100 on the Shore A scale, said overmold body being molded about a portion of said insert and said electrical cable, said wires connected to said connecting elements of said insert, said overmold body defining at least first and second segments of thread, each segment extending about a convex cylindrical surface formed on said overmold body.

20. The connector of claim 19 wherein said thread segments comprise two separated segments arranged in diametrically opposed relation and extending thereabout over an included angle in the range of approximately 60° to 120°.

21. The connector of claim 20 wherein the threads of each of said segments are screw threads arranged in a helical pattern and extend over an included angle of approximately 45°.

22. The connector of claim 21 wherein said insert defines one of a keyway and a key extending longitudinally thereof whereby when said connector is assembled to a mating connector, the mated connectors are restrained against rotation.

* * * * *